US011668447B2

(12) United States Patent
Lee

(10) Patent No.: US 11,668,447 B2
(45) Date of Patent: Jun. 6, 2023

(54) LAMP FOR AUTOMOBILE HAVING A MICRO LENS ARRAY MODULE WITH EXIT AND ENTRANCE LENS ARRAY

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/659,806

(22) Filed: Apr. 19, 2022

(65) Prior Publication Data

US 2022/0403997 A1 Dec. 22, 2022

(30) Foreign Application Priority Data

Jun. 16, 2021 (KR) ..... 10-2021-0078123

(51) Int. Cl.

| | |
|---|---|
| ***F21S 41/43*** | (2018.01) |
| ***F21S 41/265*** | (2018.01) |
| ***F21V 5/00*** | (2018.01) |
| *F21W 102/135* | (2018.01) |

(52) U.S. Cl.

CPC ..... *F21S 41/43* (2018.01); *F21S 41/265* (2018.01); *F21V 5/007* (2013.01); *F21V 5/008* (2013.01); *F21W 2102/135* (2018.01)

(58) Field of Classification Search

CPC . F21W 2102/135; F21S 41/265; F21V 5/007; F21V 5/008

See application file for complete search history.

(56) References Cited

U.S. PATENT DOCUMENTS

| | | | | |
|---|---|---|---|---|
| 10,634,307 | B2 * | 4/2020 | Kim | B60Q 1/0011 |
| 2018/0320852 | A1 * | 11/2018 | Mandl | F21S 41/151 |
| 2020/0141553 | A1 * | 5/2020 | Han | F21S 41/275 |

* cited by examiner

*Primary Examiner* — Robert J May
(74) *Attorney, Agent, or Firm* — DLA Piper LLP (US)

(57) ABSTRACT

A lamp for an automobile includes a micro lens array (MLA) module that includes an entrance lens array including entrance lenses, an exit lens array including exit lenses, and a shield unit including shields provided between the entrance lens array and the exit lens array. An optical axis of the exit lens, provided in front of at least a portion of the plurality of entrance lenses to face the entrance lens, is spaced apart from an optical axis of the entrance lens in the downward direction and one side direction. A cut-off line region provided on an upper edge of the shield, provided in front of at least a portion of the plurality of entrance lenses to face the entrance lens, is spaced apart from an optical axis of the entrance lens in the downward direction and one side direction.

19 Claims, 8 Drawing Sheets

LAMP FOR AUTOMOBILE HAVING A MICRO LENS ARRAY MODULE WITH EXIT AND ENTRANCE LENS ARRAY

CROSS-REFERENCE TO RELATED APPLICATION(S)

This application claims priority from and the benefit of Korean Patent Application No. 10-2021-0078123, filed on Jun. 16, 2021, which is hereby incorporated by reference for all purposes as if set forth herein.

TECHNICAL FIELD

Exemplary embodiments relate to a lamp for an automobile and an automobile including the lamp and, more particularly, to a lamp for an automobile, which utilizes a micro lens array, and an automobile including the lamp.

BACKGROUND

Micro lens arrays including a plurality of micro lenses are widely used in fields of micro optics such as optical communication and direct optical imaging. Particularly, recent micro lens arrays are capable of forming a specific pattern on a road surface through an optical system having a size of about 10 mm, and thus have been used as a component that performs a welcome light function in an automobile.

Meanwhile, in order to generate a low beam pattern using a lamp equipped with a micro lens array, a cut-off line of the low beam pattern has to be created. To this end, a shield needs to be provided. However, according to the related art, a large portion of light emitted from a light source of a lamp is blocked by the shield, and thus, the optical efficiency of the lamp is deteriorated.

SUMMARY

Exemplary embodiments of the present invention are to significantly reduce a ratio of light blocked by a shield with respect to light emitted from a light source of a lamp in which a micro lens array is utilized, thereby increasing optical efficiency of the lamp.

A first exemplary embodiment of the present invention provides a lamp for an automobile, the lamp including: a light source configured to generate and emit light; and a micro lens array (MLA) module which is provided in front of the light source and on which the light is incident, wherein the MLA module includes: an entrance lens array on which the light is incident and which includes a plurality of entrance lenses; an exit lens array which is provided in front of the entrance lens array, receives the light incident on the entrance lens array and emits the light to the outside, and includes a plurality of exit lenses; and a shield unit which includes a plurality of shields provided between the entrance lens array and the exit lens array, wherein an optical axis of the exit lens, which is provided in front of at least a portion of the plurality of entrance lenses to face the entrance lens, is spaced apart from an optical axis of the entrance lens in the downward direction and one side direction, wherein a cut-off line region provided on an upper edge of the shield, which is provided in front of at least a portion of the plurality of entrance lenses to face the entrance lens, is spaced apart from an optical axis of the entrance lens in the downward direction and one side direction.

The upper edge of the shield may include: an upper line region connected to one side end of the cut-off line region and provided above the cut-off line region; and a lower line region connected to the other side end of the cut-off line region and provided below the cut-off line region, wherein an optical axis of the entrance lens, which is provided behind at least a portion of the plurality of shields to face the shield, is spaced apart from the cut-off line region of the shield in the upward direction and in a side direction toward the lower line region.

An optical axis of the exit lens, which is provided in front of at least a portion of the plurality of shields to face the shield, may be aligned with the cut-off line region of the shield.

Each of optical axes of at least a portion of the plurality of entrance lenses may be horizontally spaced apart from optical axes of the plurality of exit lenses.

All of the optical axes of the plurality of entrance lenses may be horizontally spaced apart from optical axes of the plurality of exit lenses.

The vertical widths of the plurality of entrance lenses provided in the entrance lens array may be equal to each other.

The vertical widths of the plurality of exit lenses provided in the exit lens array may be equal to each other.

The entrance lens array may include a first section and a second section, and the exit lens array may include an A section and a B section, wherein the light incident on the first section is emitted from the first section and then incident on the A section, and the light incident on the second section is emitted from the second section and then incident on the B section.

The first section may be provided in the horizontal center of the entrance lens array, and the second section may be provided on each of the left side and the right side of the first section.

The A section may be provided in the horizontal center of the exit lens array, and the B section may be provided on each of the left side and the right side of the A section.

In each of the plurality of entrance lenses provided in the entrance lens array, the horizontal radius of curvature may be different from the vertical radius of curvature.

All of the optical axes of the plurality of entrance lenses provided in the second section may be horizontally spaced apart from all of the optical axes of the plurality of exit lenses provided in the B section.

The horizontal width of each of the plurality of exit lenses provided in the B section may be less than the horizontal width of each of the plurality of exit lenses provided in the A section.

In each of the plurality of exit lenses provided in the exit lens array, the horizontal curvature may be equal to the vertical curvature.

The radius of curvature of each of the plurality of exit lenses provided in the A section may be equal to the radius of curvature of each of the plurality of exit lenses provided in the B section.

The horizontal width of each of the plurality of entrance lenses provided in the first section may be equal to the horizontal width of each of the plurality of entrance lenses provided in the second section.

The horizontal radius of curvature of each of the plurality of entrance lenses provided in the first section may be different from the horizontal radius of curvature of each of the plurality of entrance lenses provided in the second section.

The lamp may further include a collimator provided between the light source and the MLA module, wherein an optical axis of the light source, an optical axis of the entrance lens array, and an optical axis of the collimator are aligned with each other.

As the curvature of an exit surface of the exit lens inside the exit lens array becomes smaller, a distance between the optical axis of the exit lens and the optical axis of the entrance lens facing the exit lens may become larger.

A second exemplary embodiment of the present invention provides an automobile including a lamp for an automobile, wherein the lamp includes: a light source configured to generate and emit light; and a micro lens array (MLA) module which is provided in front of the light source and on which the light is incident, wherein the MLA module includes: an entrance lens array on which the light is incident and which includes a plurality of entrance lenses; an exit lens array which is provided in front of the entrance lens array, receives the light incident on the entrance lens array and emits the light to the outside, and includes a plurality of exit lenses; and a shield unit which includes a plurality of shields provided between the entrance lens array and the exit lens array, wherein an optical axis of the exit lens, which is provided in front of at least a portion of the plurality of entrance lenses to face the entrance lens, is spaced apart from an optical axis of the entrance lens in the downward direction and one side direction, wherein a cut-off line region provided on an upper edge of the shield, which is provided in front of at least a portion of the plurality of entrance lenses to face the entrance lens, is spaced apart from an optical axis of the entrance lens in the downward direction and one side direction.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for an automobile and the automobile according to the present disclosure will be described with reference to the drawings.

Lamp for automobile

Figure 1:
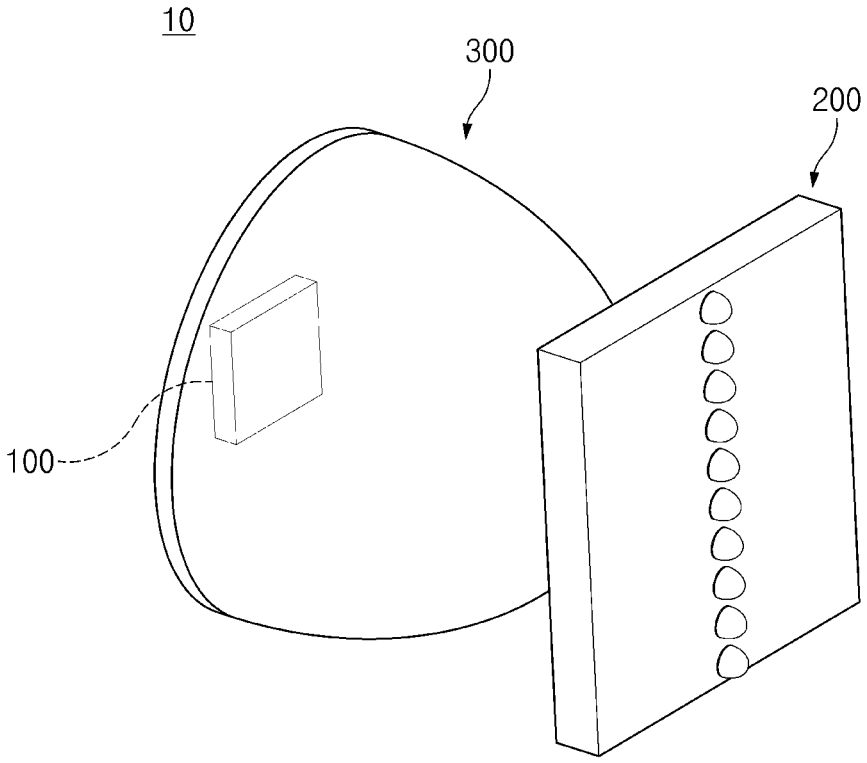
FIG. 1 is a perspective view illustrating a structure of a lamp for an automobile according to the present disclosure.
Figure 2:
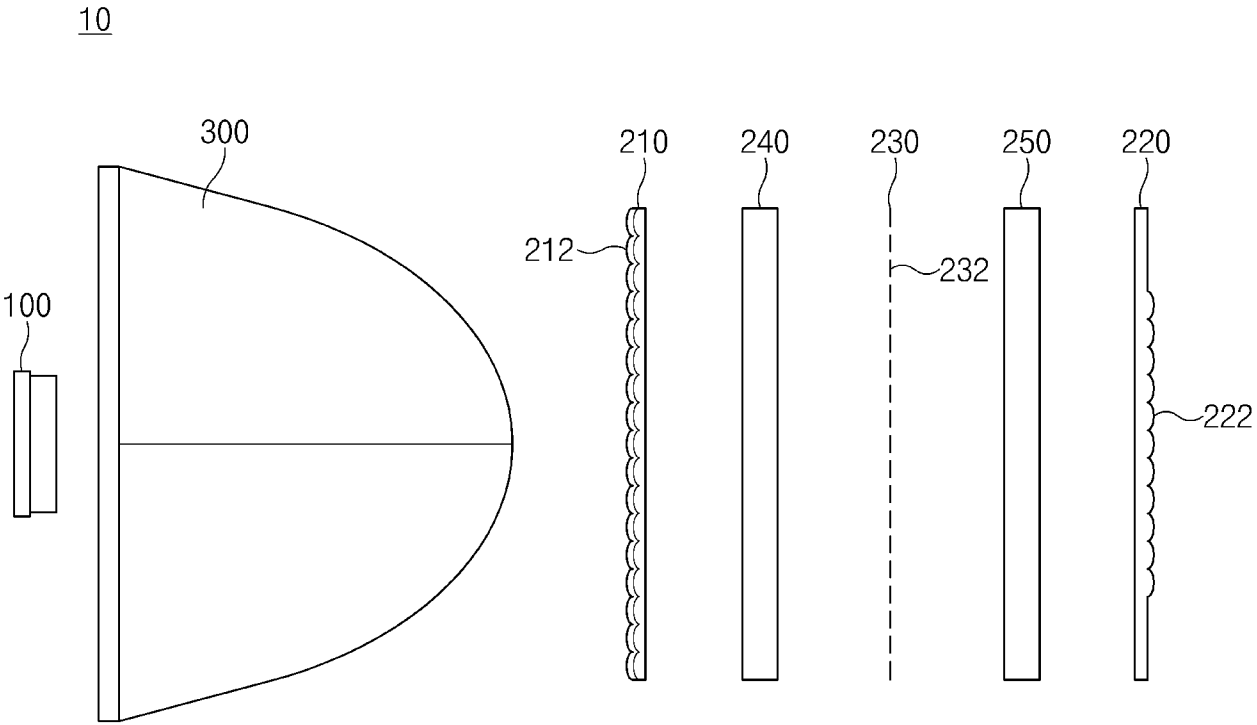
FIG. 2 is a side cross-sectional view illustrating a structure of a lamp for an automobile when an MLA module is disassembled.
Figure 3:
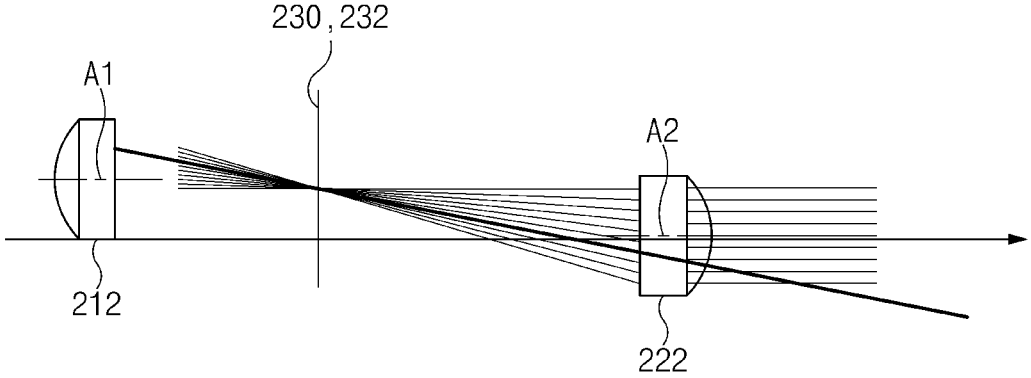
FIG. 3 is a side view illustrating a vertical arrangement relationship between an entrance lens and an exit lens provided in an MLA module of a lamp for an automobile according to the present disclosure.
Figure 4:
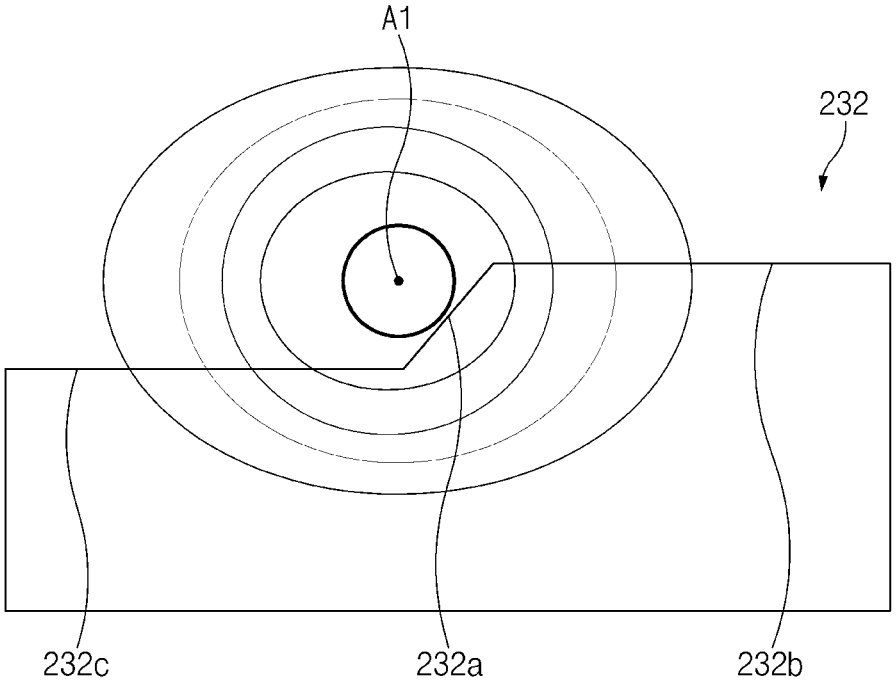
FIG. 4 is a view illustrating a position relationship between a shield and a beam pattern formed by a lamp for an automobile according to the present disclosure.
Figure 5:
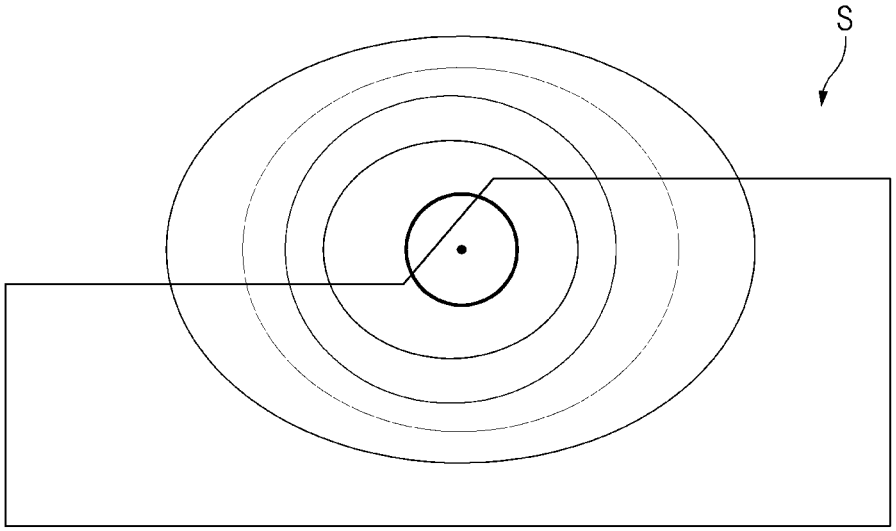
FIG. 5 is a view illustrating a position relationship between a shield and a beam pattern formed by a lamp for an automobile according to the related art.
Figure 6:
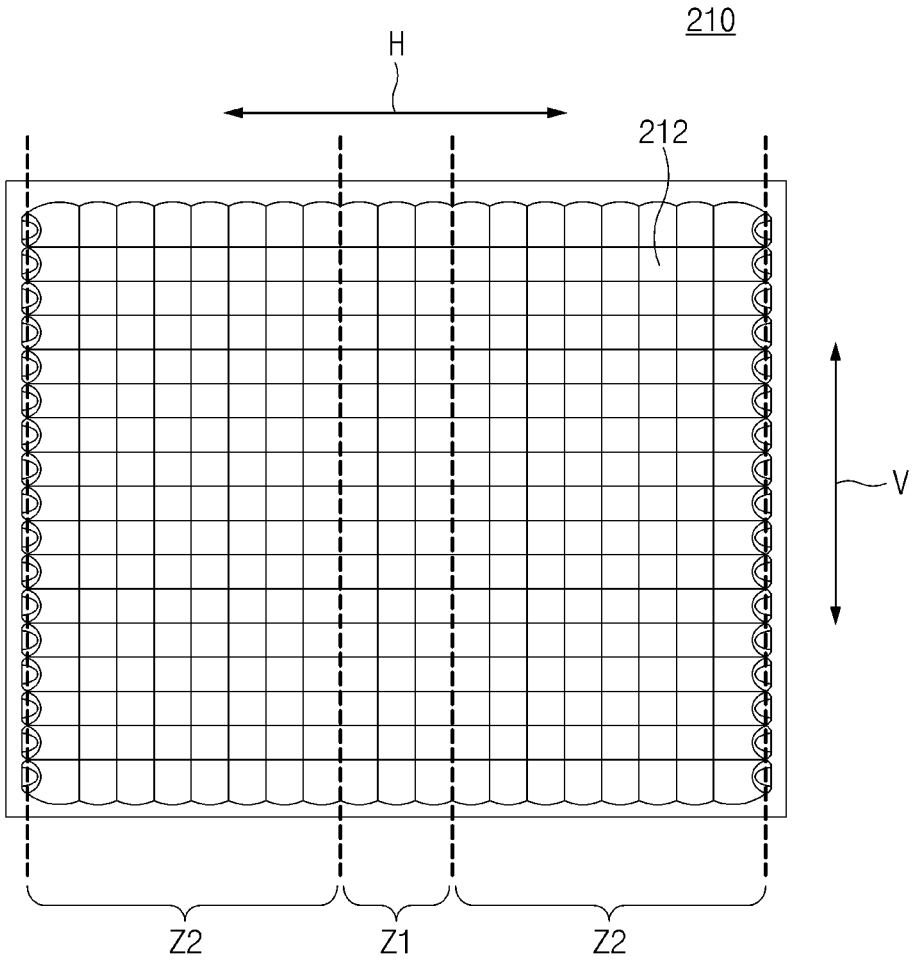
FIG. 6 is a front view illustrating a state in which an entrance lens array of a lamp for an automobile according to the present disclosure is divided into a plurality of sections.
Figure 7:
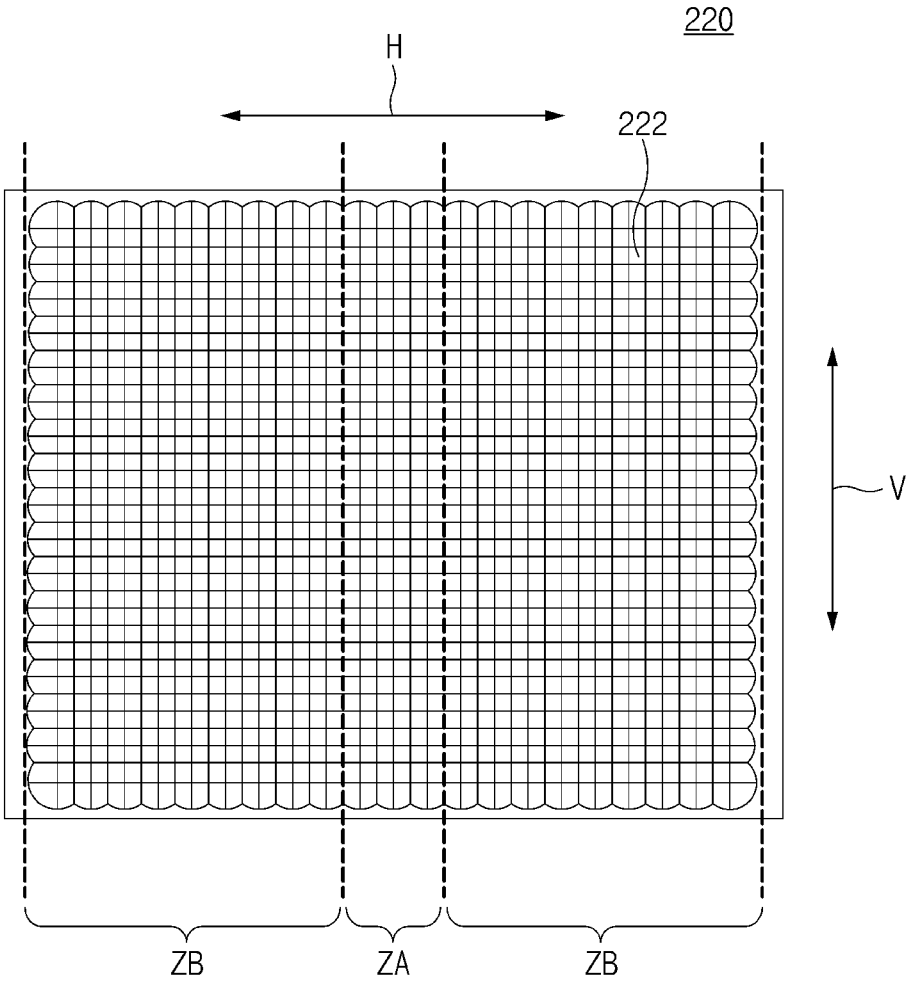
FIG. 7 is a front view illustrating a state in which an exit lens array of a lamp for an automobile according to the present disclosure is divided into a plurality of sections.
Figure 8:
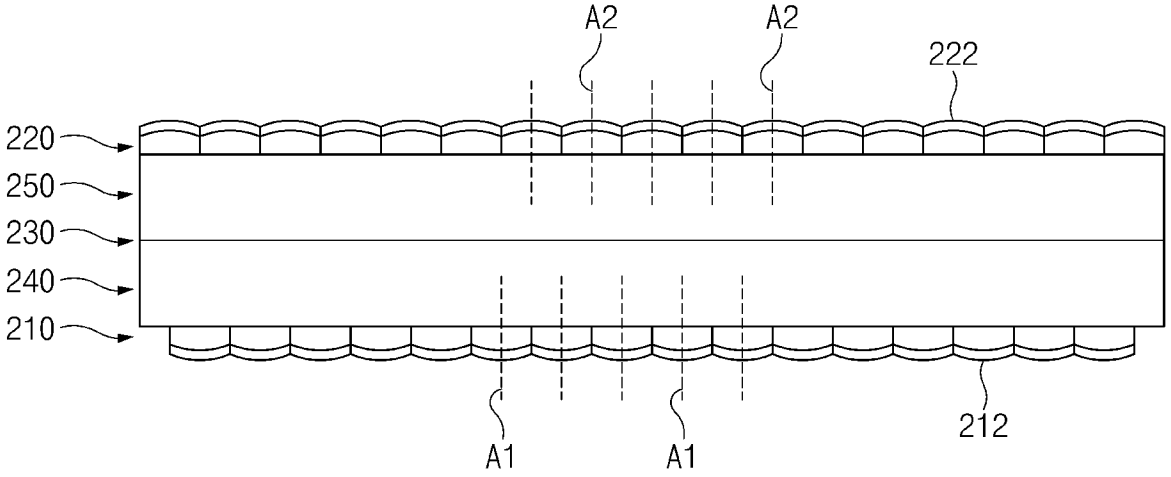
FIG. 8 is a cross-sectional view illustrating a horizontal cross-section of an MLA module of a lamp for an automobile according to the present disclosure.

FIG. 1 is a perspective view illustrating a structure of a lamp for an automobile according to the present disclosure, and FIG. 2 is a side cross-sectional view illustrating a structure of a lamp for an automobile when an MLA module is disassembled. FIG. 3 is a side view illustrating a vertical arrangement relationship between an entrance lens and an exit lens provided in an MLA module of a lamp for an automobile according to the present disclosure, and FIG. 4 is a view illustrating a position relationship between a shield and a beam pattern formed by a lamp for an automobile according to the present disclosure. FIG. 5 is a view illustrating a position relationship between a shield and a beam pattern formed by a lamp for an automobile according to the related art, and FIG. 6 is a front view illustrating a state in which an entrance lens array of a lamp for an automobile according to the present disclosure is divided into a plurality of sections. Also, FIG. 7 is a front view illustrating a state in which an exit lens array of a lamp for an automobile according to the present disclosure is divided into a plurality of sections, and FIG. 8 is a cross-sectional view illustrating a horizontal cross-section of an MLA module of a lamp for an automobile according to the present disclosure.

As illustrated in FIGS. 1 and 2, a lamp 10 for an automobile (hereinafter, referred to as a 'lamp') according to the present disclosure may include: a light source 100 which generates and emits light; and a micro lens array (MLA) module 200 which is provided in front of the light source 100 and includes a plurality of micro lenses and on which the light is incident from the light source 100. The light source 100 may be a light-emitting diode (LED), but the type of the light source is not limited thereto.

Also, the lamp 10 may further include a collimator 300 provided between the light source 100 and the MLA module 200. The collimator 300 may be configured to make light, incident from the light source 100, parallel and then emit the parallel light to the MLA module 200. However, the collimator 300 is not an essential component of the lamp 10 according to the present disclosure, and in some cases, the collimator 300 may be omitted.

Continuing to refer to FIGS. 1 to 2, the MLA module 200 may include an entrance lens array 210 which faces the collimator 300 and on which the light from the light source 100 is incident. Here, as illustrated in FIG. 6, the entrance lens array 210 may include a plurality of entrance lenses 212. Also, the plurality of entrance lenses 212 may be convex lenses convexly protruding toward the light source 100.

More specifically, in each of the plurality of entrance lenses 212 provided in the entrance lens array 210, a radius of curvature in a horizontal direction H may be different from a radius of curvature in a vertical direction V. For example, in each of the plurality of entrance lenses 212, the radius of curvature in the horizontal direction H may be less than the radius of curvature in the vertical direction V (that is, the curvature in the horizontal direction may be greater than the curvature in the vertical direction). In this case, the light, which has been emitted from the light source 100 and then incident on the entrance lens array 210, may diffuse in the horizontal direction while passing through the plurality of entrance lenses 212, and thus, the diffusion of light (particularly, the diffusion of light in the horizontal direction) may significantly occur when compared to a micro lens array according to the related art.

Also, the MLA module 200 may include an exit lens array 220 which is provided in front of the entrance lens array 210, receives the light incident on the entrance lens array 210, and emits the light to the outside. As illustrated in FIG. 7, the exit lens array 220 may include a plurality of exit lenses 222. Here, as illustrated in FIGS. 1 and 2, the plurality of exit lenses 222 may be convex lenses that protrude in the outward direction opposite to the light source 100. In each of the plurality of exit lenses 222 provided in the exit lens array 220, a radius of curvature in the horizontal direction H may be equal to a radius of curvature in the vertical direction V, unlike the plurality of entrance lenses 212 provided in the entrance lens array 210.

Meanwhile, as illustrated in FIGS. 1 and 2, the MLA module 200 may include a shield unit 230 provided between the entrance lens array 210 and the exit lens array 220. As illustrated in FIG. 4, the shield unit 230 may include a plurality of shields 232. Also, a plurality of slits may be formed between the plurality of shields 232 in the shield unit 230 so that the light emitted from the entrance lens array 210 can be incident on the exit lens array 220 therethrough. That is, according to the present disclosure, a certain beam pattern may be formed by the light, which is emitted to the outside through the slits, of the light emitted from the light source 100. Thus, the shape of the beam pattern formed by the lamp 10 according to the present disclosure may be changed depending on the shape of the shield 232.

Here, in the lamp 10 according to the present disclosure, the shield unit 230 may be provided at positions corresponding to focuses of the exit lenses 222 provided in the exit lens array 220. In this case, when taking into consideration the characteristics of a lens, the light, which arrives at the exit lens array 220 after passing through the slits of the shield unit 230 from the entrance lens array 210, may be emitted to the ground on the outside in a state of parallel light.

Here, the feature, in which the shield unit 230 is provided at the positions corresponding to the focuses of the exit lenses 222, may be interpreted as including not only a case in which the shield unit 230 and the focuses of the exit lenses 222 overlap with each other but a case in which the above-described two components are arranged so close to each other. In the latter case, it is understood, by one of ordinary skill in the art to which this disclosure belongs, that there is no substantial difference in functions and effects when compared to the case in which the above-described two components overlap with each other. However, more preferably, the focuses of the exit lenses 222 may be provided within a body of the shield unit 230.

Meanwhile, the MLA module 200 may further include: an entrance body 240 which is provided between the entrance lens array 210 and the shield unit 230 and supports the entrance lens array 210; and an exit body 250 which is provided between the exit lens array 220 and the shield unit 230 and supports the exit lens array 220. However, unlike the above structure, the MLA module 200 may not include the entrance body part 240 or the exit body part 250.

Meanwhile, the lamp 10 according to the present disclosure may be configured to form a low beam pattern of an automobile.

For this, as illustrated in FIG. 4, in order to form a cut-off line of the low beam pattern, the upper edge of the shield 232 may include: a cut-off line region 232*a* formed inclinedly; an upper line region 232*b* connected to one side end of the cut-off line region 232*a* in the horizontal direction and provided above the cut-off line region 232*a*; and a lower line region 232*c* connected to the other side end of the cut-off line region 232*a* in the horizontal direction and provided below the cut-off line region 232*a*. That is, according to the present disclosure, a stepped portion may be formed on the upper edge of the shield 232 with the cut-off line region 232*a* as a boundary.

Meanwhile, according to the present disclosure as illustrated in FIGS. 3 and 4, an optical axis A2 of the exit lens 222, which is provided in front of at least some entrance lenses 212 of the plurality of entrance lenses 212 to face the entrance lens 212, may be spaced apart from an optical axis A1 of the entrance lens 212 in the downward direction and one side direction. Also, the center of the cut-off line region 232*a* provided on the upper edge of the shield 232, which is provided in front of at least some entrance lenses 212 of the plurality of entrance lenses 212 to face the entrance lens 212, may be spaced apart from the optical axis A1 of the entrance lens 212 in the downward direction and one side direction. More preferably, according to the present disclosure, the optical axis A2 of the exit lens 222, which is provided in front of any entrance lens 212 of the plurality of entrance lenses 212 to face the entrance lens 212, may be spaced apart from the optical axis A1 of the entrance lens 212 in the downward direction and one side direction. Also, the center of the cut-off line region 232*a* provided on the upper edge of the shield 232, which is provided in front of any entrance lens 212 of the plurality of entrance lenses 212 to face the entrance lens 212, may be spaced apart from the optical axis A1 of the entrance lens 212 in the downward direction and one side direction.

FIGS. 4 and 5 illustrate isobrightness contours in which regions having the same luminous intensity are connected to each other. In the isobrightness contours, the luminous intensity increases toward the center, and the luminous intensity decreases toward the periphery of the isobrightness contours.

In a case where the optical axis of the entrance lens, the optical axis of the exit lens, and the cut-off line region of the shield are aligned with each other, a region having high luminous intensity is covered by the shield 232 as illustrated in FIG. 5. Thus, the optical efficiency of the lamp is significantly deteriorated.

However, in a case where the optical axis A2 of the exit lens 222 and the cut-off line region 232*a* of the shield 232 are spaced apart from the optical axis A1 of the entrance lens 212 in the downward direction and one side direction as described in the present disclosure, the region having the high luminous intensity but covered by the shield 232 is significantly reduced as illustrated in FIG. 4. Thus, the optical efficiency of the lamp may be significantly enhanced. Meanwhile, according to the present disclosure, an exit lens 222 facing an entrance lens 212 may represent the exit lens 222 that most overlaps the entrance lens 212 when the lamp 10 is viewed from the front or rear. Also, a shield 232 facing an entrance lens 212 may represent the shield 232 that most overlaps the entrance lens 212 when the lamp 10 is viewed from the front or rear.

Continuing to refer to FIGS. 3 and 4, the optical axis A1 of the entrance lens 212, which is provided behind at least some shields 232 of the plurality of shields 232 to face the shield 232, may be spaced apart from the center of the cut-off line region 232*a* of the shield 232 in the upward direction and in one side direction toward the lower line region 232*c*. The optical axis A1 of the entrance lens 212 is spaced apart from the center of the cut-off line region 232*a* of the shield 232 in one side direction toward the lower line region 232*c*, and this may be to minimize the region having the high luminous intensity but covered by the shield 232 as described above. More preferably, the optical axis A1 of the entrance lens 212, which is provided behind any shield 232 of the plurality of shields 232 to face the shield 232, may be spaced apart from the center of the cut-off line region 232*a* of the shield 232 in the upward direction and in one side direction toward the lower line region 232*c*.

Meanwhile, according to the present disclosure, the optical axis A2 of the exit lens 222, which is provided in front of at least some shields 232 of the plurality of shields 232 to face the shield 232, may be aligned with the cut-off line region 232*a* of the shield 232. In one example, the optical axis A2 of the exit lens 222, which is provided in front of any shield 232 of the plurality of shields 232 to face the shield 232, may be aligned with the cut-off line region 232*a* of the shield 232.

Meanwhile, referring to FIG. 8, each of optical axes A1 of at least a portion of the plurality of entrance lenses 212 may be spaced apart from optical axes A2 of the plurality of exit lenses 222 in the horizontal direction H. This may be to ensure that the beam pattern formed by the lamp 10 according to the present disclosure has a shape diffused in the left-right direction. More preferably, all of the optical axes A1 of the plurality of entrance lenses 212 may be spaced apart from the optical axes A2 of the plurality of exit lenses 222 in the horizontal direction H.

Also, according to the present disclosure, the widths of the plurality of entrance lenses 212 in the vertical direction V, which are provided in the entrance lens array 210, may be equal to each other, and the widths of the plurality of exit lenses 222 in the vertical direction V, which are provided in the exit lens array 220, may also be equal to each other.

Meanwhile, in the lamp according to the present disclosure, the entrance lens array 210 and the exit lens array 220 may be divided into a plurality of sections according to characteristics of the entrance lenses and the exit lenses, respectively.

That is, referring to FIGS. 6 and 7, the entrance lens array 210 may include a first section Z1 and a second section Z2, and the exit lens array 220 may include an A section ZA and a B section ZB. More specifically, the light, which has been emitted from the light source 100 and then incident on the first section Z1, may be emitted from the first section Z1 and then incident on the A section ZA, and the light, which has been incident on the second section Z2, may be emitted from the second section Z2 and then incident on the B section ZB. More preferably, the light, which is emitted to the outside after passing through the first section Z1 and the A section ZA, may provide a central region of a beam pattern formed outside by the lamp 10 according to the present disclosure, and the light, which is emitted to the outside after passing through the second section Z2 and the B section ZB, may provide a peripheral region of the beam pattern formed outside by the lamp 10 according to the present disclosure.

In one example, as illustrated in FIG. 6, the first section Z1 may be provided on a central region of the entrance lens array 210 in a horizontal direction H, and the second section Z2 may be provided on each of the left side and the right side of the first section Z1. Here, FIG. 6 illustrates a case where the first section Z1 and the second section Z2 are in contact with each other, but unlike this case, the first section Z1 and the second section Z2 may be spaced apart from each other. For example, a third section including a plurality of entrance lenses may be provided between the first section Z1 and the second section Z2.

Also, in one embodiment, as illustrated in FIG. 7, the A section ZA may be provided on a central region of the exit lens array 220 in a horizontal direction H, and the B section ZB may be provided on each of the left side and the right side of the A section ZA. Meanwhile, FIG. 7 illustrates a case where the A section ZA and the B section ZB are in contact with each other, but unlike this case, the A section ZA and the B section ZB may be spaced apart from each other. For example, a C section including a plurality of exit lenses may be provided between the A section ZA and the B section ZB.

Meanwhile, according to the present disclosure as described above, all of the optical axes A1 of the plurality of entrance lenses 212 may be spaced apart from the optical axes A2 of the plurality of exit lenses 222 in the horizontal direction H. More specifically, all of the optical axes A1 of the plurality of entrance lenses 212 provided in the second section Z2 may be horizontally spaced apart from all of the optical axes A2 of the plurality of exit lenses 222 provided in the B section ZB.

Meanwhile, referring to FIG. 7, the width of each of the plurality of exit lenses 222 in the horizontal direction H, which are provided in the B section ZB, may be less than the width of each of the plurality of exit lenses 222 in the horizontal direction H, which are provided in the A section ZA. Also, the radius of curvature of each of the plurality of exit lenses 222 provided in the A section ZA may be equal to the radius of curvature of each of the plurality of exit lenses 222 provided in the B section ZB.

On the other hand, referring to FIG. 6, the width of each of the plurality of entrance lenses 212 in the horizontal direction H, which are provided in the first section Z1, may be equal to the width of each of the plurality of entrance lenses 212 in the horizontal direction H, which are provided in the second section Z2. Also, the radius of curvature of each of the plurality of entrance lenses 212 in the horizontal direction H, which are provided in the first section Z1, may be different from the radius of curvature of each of the plurality of entrance lenses 212 in the horizontal direction H, which are provided in the second section Z2.

Meanwhile, according to the present disclosure, the optical axis of the light source 100 provided in the lamp 10, the optical axis of the entrance lens array 210, and the optical axis of the collimator 300 may be aligned with each other. This may be to minimize an optical loss while the light emitted from the light source 100 arrives at the entrance lens array 210 via the collimator 300, thereby maximizing the optical efficiency of the lamp 10.

Meanwhile, in the lamp according to the present disclosure, as the curvature of an exit surface of the exit lens 222 inside the exit lens array 220 becomes smaller (that is, as the radius of curvature becomes larger), a distance between the optical axis of the exit lens 222 and the optical axis of the entrance lens 212 facing the exit lens 222 may become larger. Also, as the curvature of the exit surface of the exit lens 222 becomes smaller, a distance between the exit lens 222 and the entrance lens 212 may become larger.

Automobile

An automobile according to the present disclosure may include a lamp 10 for an automobile (hereinafter, referred to as a 'lamp').

Here, the lamp 10 may include: a light source 100 which generates and emits light; and a micro lens array (MLA) module 200 which is provided in front of the light source 100 and on which the light is incident. Also, the MLA module 200 may include: an entrance lens array 210 on which the light is incident and which includes a plurality of entrance lenses 212; an exit lens array 220 which is provided in front of the entrance lens array 210, receives the light incident on the entrance lens array 210 and emits the light to the outside, and includes a plurality of exit lenses 220; and a shield unit 230 which includes a plurality of shields 232 provided between the entrance lens array 210 and the exit lens array 220.

Here, according to the present disclosure, an optical axis A2 of the exit lens 222, which is provided in front of at least some entrance lenses 212 of the plurality of entrance lenses 212 to face the entrance lens 212, may be spaced apart from an optical axis A1 of the entrance lens 212 in the downward direction and one side direction. A cut-off line region 232*a* provided on an upper edge of the shield 232, which is provided in front of at least some entrance lenses 212 of the plurality of entrance lenses 212 to face the entrance lens 212, may be spaced apart from an optical axis A1 of the entrance lens 212 in the downward direction and one side direction.

According to the present disclosure, it is possible to significantly reduce a ratio of light blocked by the shield with respect to the light emitted from the light source of the lamp in which the micro lens array is utilized, thereby increasing optical efficiency of the lamp.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for an automobile, the lamp comprising:

a light source configured to generate and emit light; and a micro lens array (MLA) module provided in front of the light source and on which the light is incident, wherein the MLA module comprises:

an entrance lens array on which the light is incident and which comprises a plurality of entrance lenses;

an exit lens array provided in front of the entrance lens array to receive the light incident on the entrance lens array and emit the light outside the lamp, the exit lens array comprises a plurality of exit lenses; and a shield unit comprising a plurality of shields provided between the entrance lens array and the exit lens array, wherein an optical axis of at least one of the plurality of exit lenses, provided in front of at least a portion of the plurality of entrance lenses to face at least one of the plurality of entrance lenses, is spaced apart from an optical axis of the entrance lens in a downward direction and one side direction, wherein a cut-off line region provided on an upper edge of the shield, provided in front of at least a portion of the plurality of entrance lenses to face the entrance lens, is spaced apart from an optical axis of the entrance lens in the downward direction and one side direction, wherein the upper edge of the shield comprises:

an upper line region connected to one side end of the cut-off line region and provided above the cut-off line region; and a lower line region connected to another side end of the cut-off line region and provided below the cut-off line region, and wherein an optical axis of the entrance lens, provided behind at least a portion of the plurality of shields to face the shield, is spaced apart from the cut-off line region of the shield in an upward direction and in one side direction toward the lower line region.

2. The lamp of claim 1, wherein an optical axis of the exit lens, provided in front of at least a portion of the plurality of shields to face the shield, is aligned with the cut-off line region of the shield.

3. The lamp of claim 1, wherein each of optical axes of at least a portion of the plurality of entrance lenses is horizontally spaced apart from optical axes of the plurality of exit lenses.

4. The lamp of claim 1, wherein optical axes of the plurality of entrance lenses are horizontally spaced apart from optical axes of the plurality of exit lenses.

5. The lamp of claim 1, wherein vertical widths of the plurality of entrance lenses provided in the entrance lens array are equal to each other.

6. The lamp of claim 1, wherein vertical widths of the plurality of exit lenses provided in the exit lens array are equal to each other.

7. The lamp of claim 1, wherein, in each of the plurality of entrance lenses provided in the entrance lens array, a horizontal radius of curvature is different from a vertical radius of curvature.

8. The lamp of claim 1, wherein, in each of the plurality of exit lenses provided in the exit lens array, a horizontal curvature is equal to a vertical curvature.

9. The lamp of claim 1, further comprising a collimator provided between the light source and the MLA module, wherein an optical axis of the light source, an optical axis of the entrance lens array, and an optical axis of the collimator are aligned with each other.

10. The lamp of claim 1, wherein as a curvature of an exit surface of the exit lens inside the exit lens array becomes smaller, a distance between the optical axis of the exit lens and the optical axis of the entrance lens facing the exit lens becomes larger.

11. A lamp for an automobile, the lamp comprising:

a light source configured to generate and emit light; and a micro lens array (MLA) module provided in front of the light source and on which the light is incident, wherein the MLA module comprises:

an entrance lens array on which the light is incident and which comprises a plurality of entrance lenses;

an exit lens array provided in front of the entrance lens array to receive the light incident on the entrance lens array and emit the light outside the lamp, the exit lens array comprises a plurality of exit lenses; and a shield unit comprising a plurality of shields provided between the entrance lens array and the exit lens array, wherein an optical axis of at least one of the plurality of exit lenses, provided in front of at least a portion of the plurality of entrance lenses to face at least one of the plurality of entrance lenses, is spaced apart from an optical axis of the entrance lens in a downward direction and one side direction, wherein a cut-off line region provided on an upper edge of the shield, provided in front of at least a portion of the plurality of entrance lenses to face the entrance lens, is spaced apart from an optical axis of the entrance lens in the downward direction and one side direction, wherein the entrance lens array comprises a first section and a second section, and the exit lens array comprises an A section and a B section, wherein the light incident on the first section is emitted from the first section and then incident on the A section, and the light incident on the second section is emitted from the second section and then incident on the B section.

12. The lamp of claim 11, wherein the first section is provided in a horizontal center of the entrance lens array, and the second section is provided on each of a left side and right side of the first section.

13. The lamp of claim 12, wherein the A section is provided in the horizontal center of the exit lens array, and the B section is provided on each of the left side and the right side of the A section.

14. The lamp of claim 11, wherein optical axes of the plurality of entrance lenses provided in the second section are horizontally spaced apart from optical axes of the plurality of exit lenses provided in the B section.

15. The lamp of claim 11, wherein a horizontal width of each of the plurality of exit lenses provided in the B section is less than a horizontal width of each of the plurality of exit lenses provided in the A section.

16. The lamp of claim 15, wherein a radius of curvature of each of the plurality of exit lenses provided in the A section is equal to a radius of curvature of each of the plurality of exit lenses provided in the B section.

17. The lamp of claim 11, wherein a horizontal width of each of the plurality of entrance lenses provided in the first section is equal to a horizontal width of each of the plurality of entrance lenses provided in the second section.

18. The lamp of claim 17, wherein a horizontal radius of curvature of each of the plurality of entrance lenses provided in the first section is different from a horizontal radius of curvature of each of the plurality of entrance lenses provided in the second section.

19. An automobile comprising a lamp for an automobile, wherein the lamp comprises:

a light source configured to generate and emit light; and a micro lens array (MLA) module provided in front of the light source and on which the light is incident, wherein the MLA module comprises an entrance lens array on which the light is incident and which comprises a plurality of entrance lenses;

an exit lens array is provided in front of the entrance lens array to receive the light incident on the entrance lens array and emit the light outside the lamp, the exit lens array comprising a plurality of exit lenses; and a shield unit comprises a plurality of shields provided between the entrance lens array and the exit lens array, wherein an optical axis of at least one of the plurality of exit lenses, provided in front of at least a portion of the plurality of entrance lenses to face at least one of the plurality of entrance lenses, is spaced apart from an optical axis of the entrance lens in a downward direction and one side direction, wherein a cut-off line region provided on an upper edge of the shield, provided in front of at least a portion of the plurality of entrance lenses to face the entrance lens, is spaced apart from an optical axis of the entrance lens in the downward direction and one side direction, wherein as a curvature of an exit surface of the exit lens inside the exit lens array becomes smaller, a distance between the optical axis of the exit lens and the optical axis of the entrance lens facing the exit lens becomes larger.

* * * * *